US006102211A

United States Patent [19]

Krenzler

[11] Patent Number: 6,102,211

[45] Date of Patent: Aug. 15, 2000

[54] ROTATING GOLD PAN ASSEMBLY

[75] Inventor: Leo M. Krenzler, Des Moines, Wash.

[73] Assignee: Michael & Susan Bartkoski, Columbia Falls, Mont.

[21] Appl. No.: 09/346,712

[22] Filed: Jul. 2, 1999

[51] Int. Cl.[7] ..... B03B 5/04

[52] U.S. Cl. ..... 209/434; 209/444; 209/451; 209/505; 209/508; 15/260

[58] Field of Search ..... 209/44, 434, 444, 209/451, 452, 506, 505, 508; 15/257.01, 257.5, 260; 220/700, 701

[56] References Cited

U.S. PATENT DOCUMENTS 4,406,783 9/1983 Cleland ..... 209/444
5,333,353 8/1994 Taylor ..... 15/260 X
5,548,865 8/1996 Pagani ..... 15/260 X
5,868,366 2/1999 Tubbs, Jr. ..... 209/434 X

*Primary Examiner*—Tuan N. Nguyen
*Attorney, Agent, or Firm*—Delbert J. Barnard

[57] ABSTRACT

A separator pan (18) is set into a rearwardly leaning position (FIG. 6). A lower portion of the pan (18) is positioned inside a bucket (10). The pan (18) is mounted for rotation on a frame (20). The frame (20) includes hooks (42) that hook onto the upper rim (32) of the bucket (10). The support leg or brace (82) projects rearwardly from a lower portion of the frame (20) to contact the sidewall (28) of the bucket (10), and establish a lean angle of the pan (18). The pan (18) is detachable from the frame (20) and the pan (18) and the frame (20) are sized to be placed inside of the bucket (10) so that the bucket (10) can be used for transporting and storing the assembly when it is not being used.

16 Claims, 5 Drawing Sheets

FIG. 1
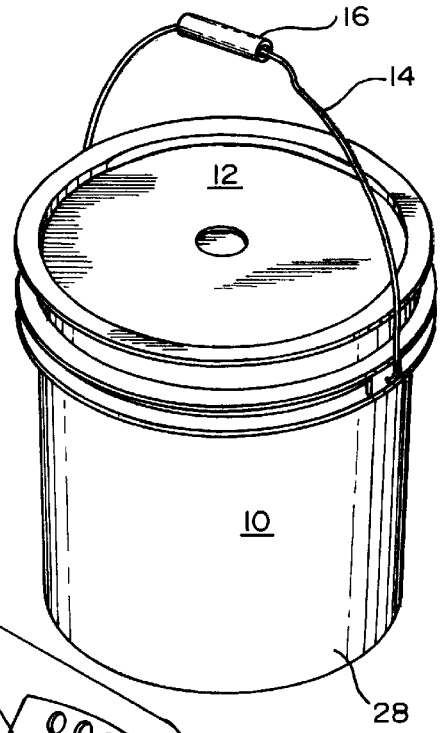
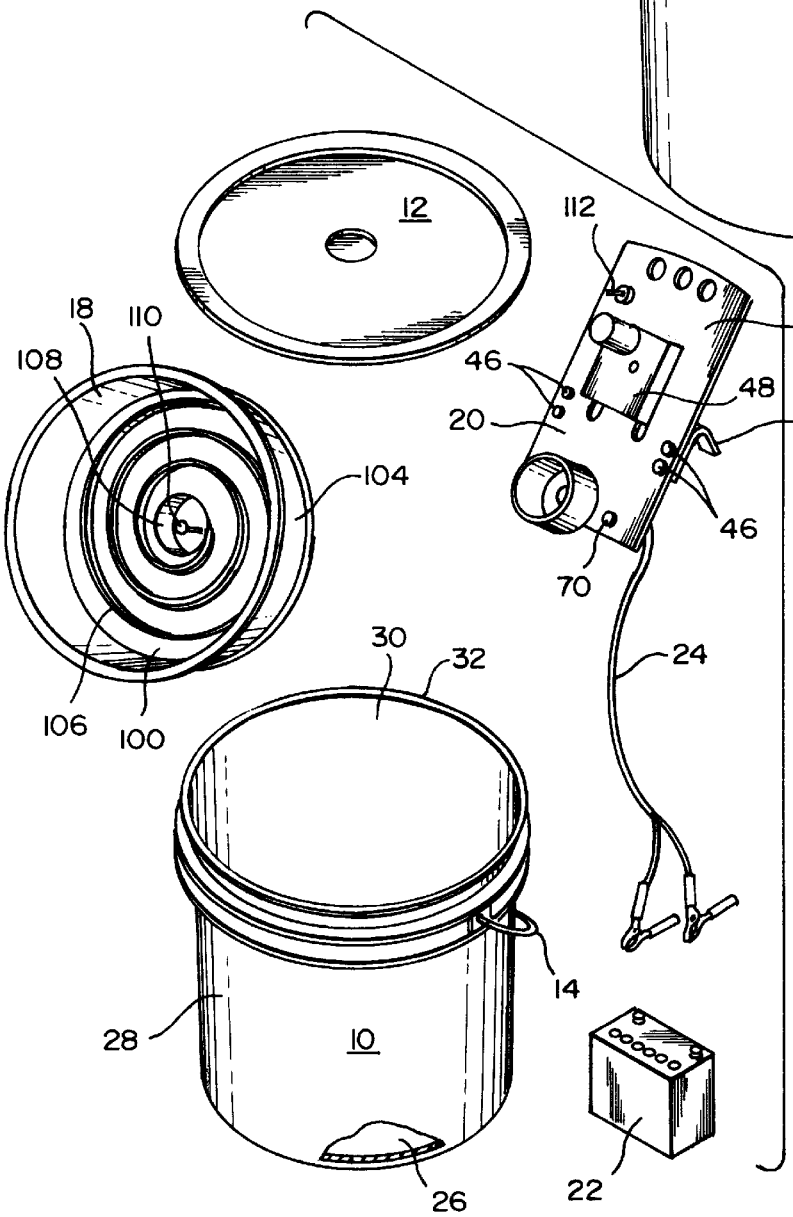
FIG. 2

ROTATING GOLD PAN ASSEMBLY

TECHNICAL FIELD

This invention relates to rotating gold pans for separating gold particles from gold ore. More particularly, it relates to the provision of a new and unique support structure for the rotating gold pan characterized by a small frame and a bucket.

BACKGROUND ART

The background art portions of my U.S. Pat. No. 5,273,165, granted Dec. 28, 1993, and entitled, "Rotating Gold Pan For Separating Gold Particles From Ore"; No. 5,275,294, granted Jan. 4, 1994, and entitled, "Rotating Gold Pan For Separating Gold Particles From Ore"; and No. 5,788,293, granted Aug. 4, 1998, and entitled, "Gold Pan With Agitator Knobules And Insert Cup," and my co-pending application Serial No. 08/961,588, filed Oct. 21, 1997 and entitled, "Gold Pan With Water Delivery Cups," are hereby incorporated herein by this specific reference.

The rotating gold pan assemblies disclosed by my above-identified patents and application are made to be portable. They comprise a rotating gold pan and a support frame that includes a drive motor and a drive belt and pulley system for connecting the drive motor to the gold pan. The gold pan is separable from the frame the frame is foldable to make it smaller for transportation and storage.

It is an object of the present invention to provide a gold pan/frame assembly that is smaller than the prior art gold pan assemblies.

It is further object of the invention to provide a gold pan/frame assembly that includes a rotating gold pan, a small frame and a bucket, wherein the bucket is adapted to be a carrier for the gold pan and frame and a primary part of the support structure.

BRIEF SUMMARY OF THE INVENTION

The gold pan assembly of the invention includes a rotatable separator pan rotatably mounted on a frame. The frame and pan are mountable on the side wall of a bucket, with lower portions of the pan and frame inside the bucket.

The preferred embodiment includes a bucket having a bottom and a sidewall extending upwardly from the bottom to form a bucket interior. A frame is provided that has an upper end, a lower end, a front side and a rear side. At least one hook is provided on the rear side of the frame and is adapted to hook onto the upper edge of the bucket while the lower end of the frame is in the bucket interior. A rotatable separator pan is mountable on the front side of the frame. The pan includes a bottom wall with front and rear sides and a perimeter, a gold particle collecting hub region, a sidewall projecting forwardly from the perimeter of the bottom wall, and a spiral rib on the front side of the bottom wall, spiraling inwardly from the sidewall to the gold particle collecting hub region. A motor is provided on the frame and is connected to the pan for rotating the pan relative to the frame and bucket. A brace is provided on the frame below the hook. The brace extends rearwardly from the frame into contact with the sidewall of the bucket. The brace holds the frame and the pan in rearwardly leaning positions.

In preparation for use, the pan is placed on the frame, lower portions of the frame and the pan are placed in the bucket interior, and the hook is hooked onto the upper edge of the sidewall of the bucket. The brace is positioned against the sidewall, to support the frame and the pan in rearwardly leaning positions on the bucket. In use, gold ore is introduced into the pan while the pan is rotating. Relatively large particles of the ore gravitate radially across the pan and the rib, over the pan sidewall, and out of the pan, into the bucket. Small gold particles are held by the rib and are moved by the rib upwardly along the spiral path of the rib into the gold particle collecting hub region of the pan.

The gold particle collecting hub region of the separator pan may include a hub housing projecting rearwardly from the bottom of the pan and a removable gold particle collecting cup that is fittable into the housing from the front side of the pan.

A second, forwardly directed housing may be mounted for rotation on the frame and be connected to the motor to be rotated by the motor. The rearwardly projected housing on the pan may be snugly plugable into the forwardly opening second housing on the frame, to provide a drive connection between the pan and the second housing in the motor.

According to an aspect of the invention, the brace is adjustable in length, for adjusting the lean angle of the frame and pan relative to the bucket.

According to another aspect of the invention, a handle is provided at the upper end of the frame.

In some embodiments, the motor may be mounted on the upper part of the frame and include a drive shaft that projects rearwardly through the frame. A driven shaft may be mounted on a lower portion of the frame. The driven shaft has a front portion that extends forwardly from the frame and is connected to the rotatable separator pan, and a rear portion that projects rearwardly from the frame. A drive pulley is provided on the drive shaft rearwardly of the frame. A driven pulley is provided on the driven shaft, rearwardly of the frame. A drive belt interconnects the drive pulley and the driven pulley.

According to an aspect of the invention, the pan is detachable from the frame and the pan and the frame are sized to when detached be fittable into the bucket interior.

The bucket may include an opening in its sidewall, in which case the frame is hooked onto the bucket at a location that is substantially diametrically opposite the opening. As a result, gold ore falling into the bucket will flow out from the bucket through the opening in the sidewall of the bucket.

Other objects, advantages and features of the invention will become apparent from the description of the best mode set forth below, from the drawings, from the claims and from the principles that are embodied in the specific structures that are illustrated and described.

BRIEF DESCRIPTION OF THE SEVERAL VIEWS OF THE DRAWING

In the drawings, like reference numerals and letters refer to like parts throughout the several views, and:

FIG. 1 is an assembled pictorial view of a gold pan assembly that incorporates the present invention, such view being taken from above and looking towards the top and one side of the bucket gold pan assembly;

FIG. 2 is an exploded pictorial view taken from above and looking towards the top and one side of the major components of the separator shown by FIG. 1;

DETAILED DESCRIPTION OF THE INVENTION

Figure 3:
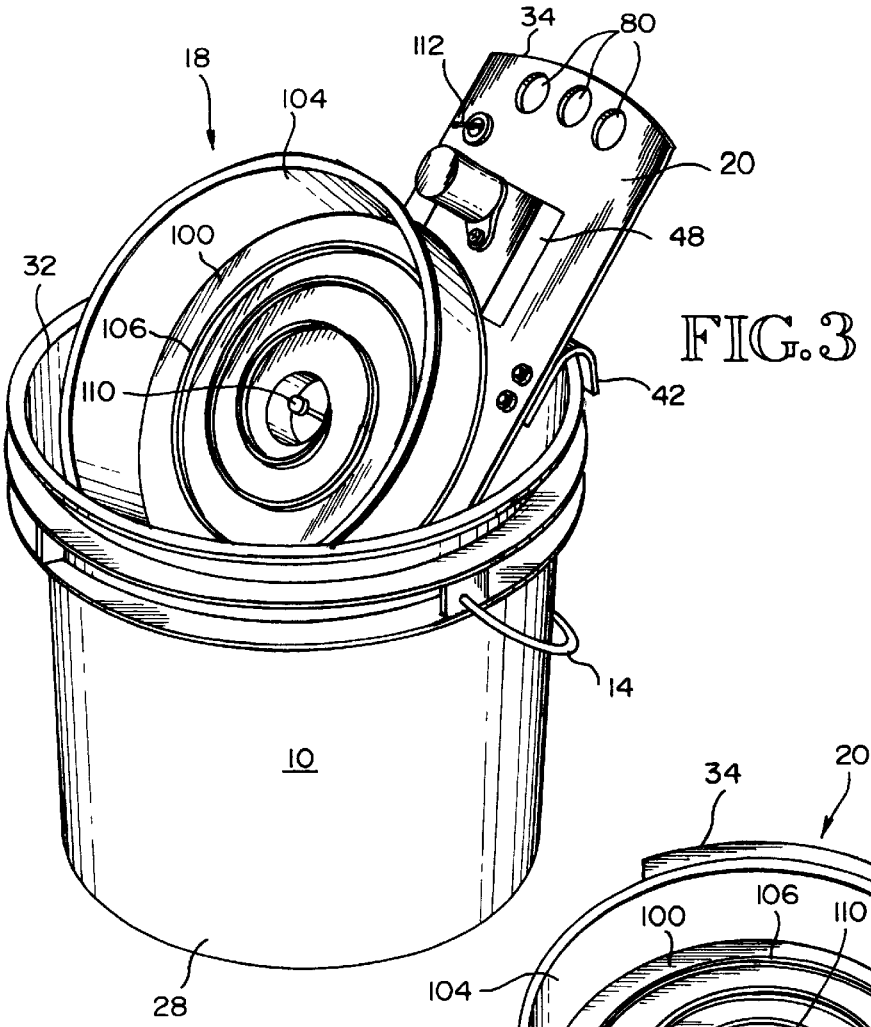
FIG. 3 is a pictorial view taken from above and looking towards the top and one side of the gold pan assembly, showing its parts positioned for use.

Referring more specifically to the drawing, FIG. 1 shows a bucket 10 having a lid 12, a bail 14 and a handle 16 on the bail 14. As is well known per se, the bail 14 is swingable downwardly to place it and the handle 16 adjacent a sidewall portion of the bucket 10. By way of typical and therefore non-limitive example, the bucket 10 may be a three and one half U.S. gallon bucket such as manufactured by Ropak of Fullerton, Calif., Model No. NRC.075. This bucket is equipped with a snap-on lid that is disclosed in U.S. Pat. No. 5,103,993, granted Apr. 14, 1992 to Joesf E. Bingisser, and entitled "Container Lid Having Non-Perpendicular Reinforcement Ribs". What FIG. 1 does not show are a rotatable separator pan 18, a frame 20 that includes power drive equipment for rotating the pan 18, a battery 22 and a battery cable 24, all shown in FIG. 2. These components 18, 20, 22, 24 and the bucket 10 together make up the gold pan assembly of the present invention. These components 18, 20, 22, 24 are of such a size that when they are disassembled that can all be placed in the bucket 10. The lid 12 can be installed and then the disassembled equipment is ready to be carried from place to place by use of the bail and handle 14, 16. The disassembled assembly can be stored in this configuration, but with the bail and handle 14, 16 swung downwardly against a side portion of the bucket 10.

Bucket 10 has a bottom 26 (FIG. 2) and a sidewall 28 extending upwardly from the bottom 26 to form a bucket interior 30. The sidewall 28 has an upper edge 32.

Figure 6:
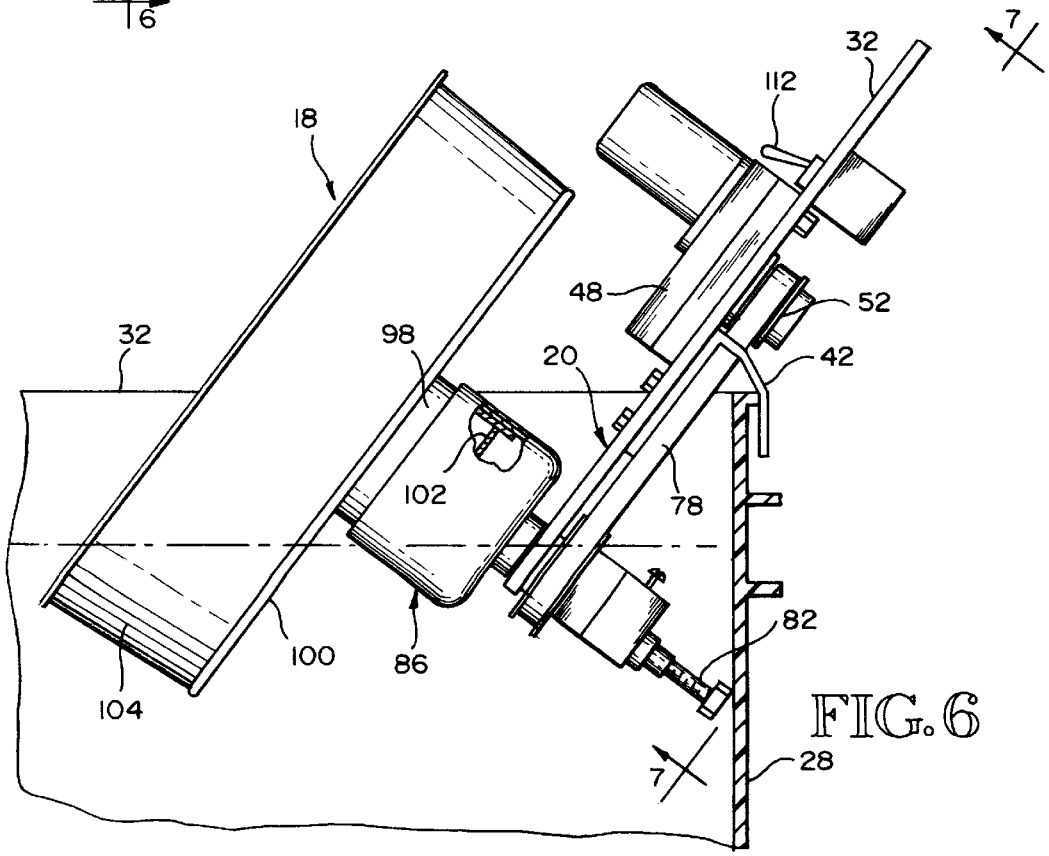
FIG. 6 is a sectional view taken substantially along line 6—6 of FIG. 5, and showing some parts in side elevation.
Figure 7:
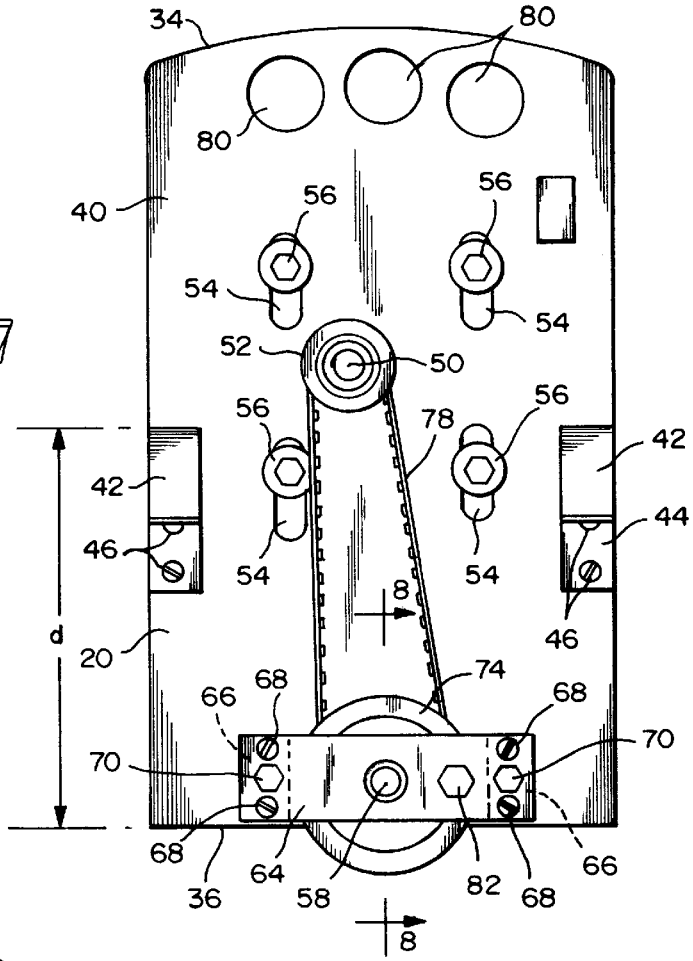
FIG. 7 is a rear elevational view of the frame and the components mounted on the frame, minus the rotating gold pan, such view being taken substantially from the aspect of 7—7 in FIG. 6, but with the bucket also omitted.

Referring specifically to FIGS. 2, 6 and 7, the frame 20 may be in the form of a substantially rectangular panel having an upper end 34, a lower end 36, a front side 38 (FIG. 2) and a rear side 40 (FIG. 7). Preferably, the frame 20 is constructed from a structural plastic material. By way of typical and therefore non-limitive example, frame 20 may be about six inches wide, about ten inches long and about one quarter inch thick. As best shown by FIGS. 6 and 7, the frame 20 is provided with a pair of hooks 42, 44. The hooks 42, 44 may include a straight mounting leg having a pair of bolt receiving openings and a bent hook portion extending rearwardly and downwardly from the mounting portion. A pair of nut and bolt assemblies 46 (FIG. 7) may be used for connecting the hooks 42, 44 to the frame 20. In the illustrated example, the distance d measuring from the top of the hooks 42, 44 down to the bottom end 36 of the frame 20 they measure about four and three quarters inches.

Figure 5:
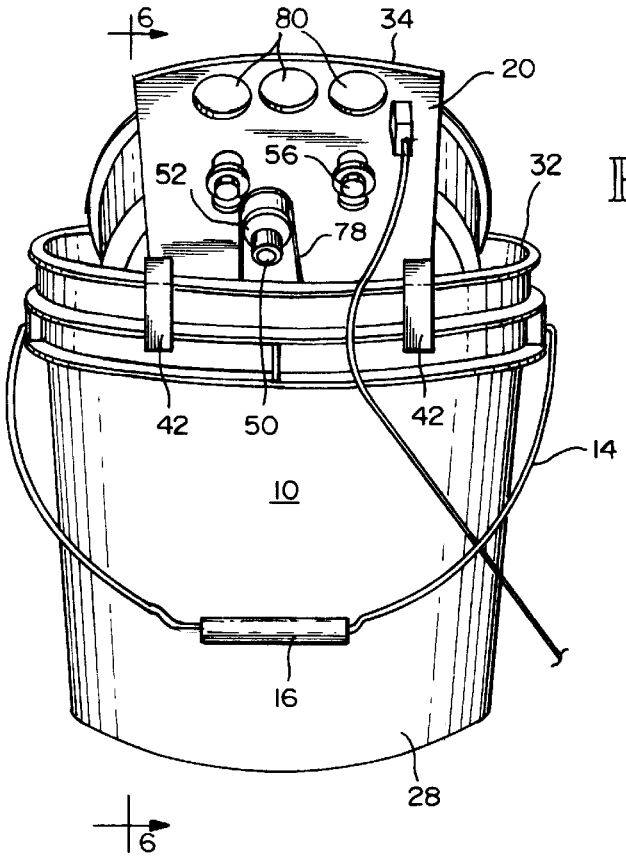
FIG. 5 is a view like FIG. 4, but looking towards the rear of the assembly.

Referring to FIGS. 2 and 6, a small electric drive motor 48 may be secured to an upper portion of the frame 20. The motor 48 is positioned on the front side 38 of the frame 20 but it includes a drive shaft 50 (FIGS. 5 and 7) that projects rearwardly through an opening (not shown) in the frame 20 to a drive pulley 52 (FIGS. 5–7) that is positioned rearwardly of the frame 20. Frame 20 may include four bolt receiving slots 54 that are elongated lengthwise of the frame 20 (FIG. 7). These slots 54 receive mounting screws 56 which extend forwardly through the slots 54 and screw into threaded openings in the back side of the housing of the motor 48. The mounting screws 56 have heads that are wider than the slots 54 (FIG. 7). Thus, when the mounting screws 56 are tightened, edge portions bear against portions of the frame 20 that border the slots 54 and clamp the motor 48 to the frame 20.

As best shown by FIGS. 1, 6 and 7, a driven shaft 58 is mounted on the frame 20 near the lower end (36) of the frame 20. Driven shaft 58 extends forwardly through a front bearing 16 that is mounted on frame 20 and rearwardly through a rear bearing 62 that is mounted on the cross member 64 that is based rearwardly of the frame 20. At its ends, cross member 64 is connected to posts 66 that are connected at their front ends to the frame 20 and project rearwardly from the frame 20. The screws 68 and nut and bolt assemblies 70 may be used for connecting the cross member 64 to the post 66. Bushing 62 may be held in place relative to the cross member 64 by a set screw 72.

Figure 8:
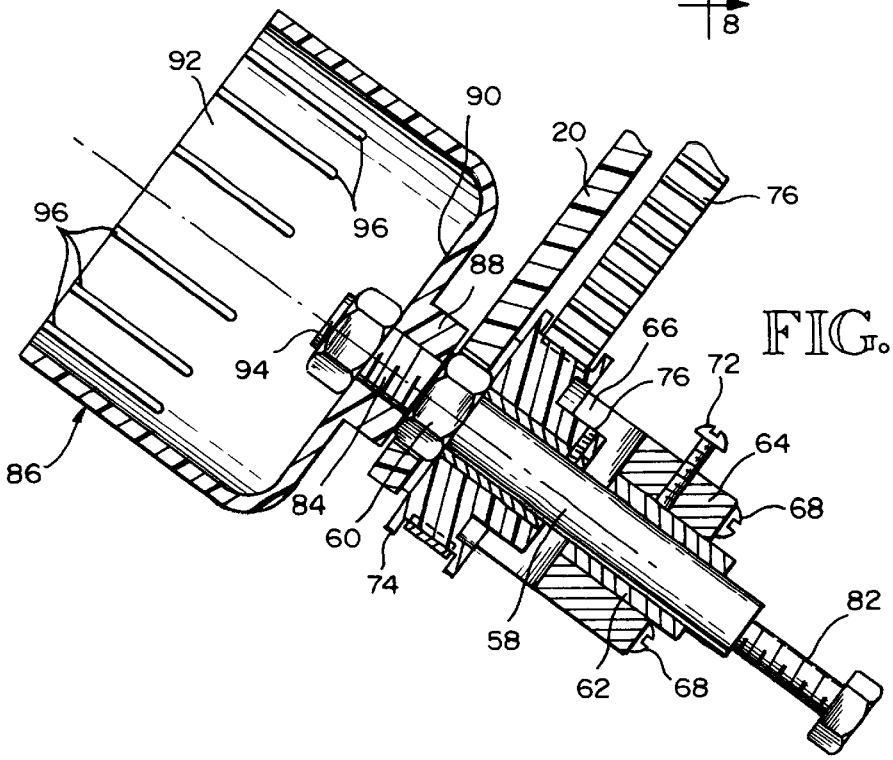
FIG. 8 is an enlarged scale sectional view taken substantially along line 8—8 of FIG. 7.

As best shown by FIG. 8, a driven pulley 74 is connected to the driven shaft 58, such as by a set screw 76. A drive belt 78 is shown drivenly connecting the drive pulley 52 to the driven pulley 74. As clearly illustrated, the driven shaft 58 and the driven pulley 74 are mounted for rotation about a fixed axis. The drive shaft 50 and drive pulley 52 are mounted for rotation about an axis that is fixed relative to the housing of the drive motor 48. However, this axis is adjustable in position relative to the frame 20. As will be readily appreciated by persons skilled in the art, the drive pulley 78 is installed on the driven pulley 74 before the cross member 64 is connected to the post 66. The motor 48 is positioned on the front side (38) of the frame 20, with its drive shaft 50 projecting rearwardly through the frame 20. Then the drive pulley 52 is placed on the drive shaft 50, rearwardly of the frame 20 and is secured to the drive shaft 50, such as by use of a set screw (not shown). The mounting screws 56 are loosely installed, either before or after the drive pulley 52 is installed. Then, while the mounting screws 56 remain loose, the drive motor 48 is pushed upon to move it upwardly towards the upper end (34) of the frame 20. This moves the drive pulley 52 upwardly and puts tension in the drive belt 78. The drive motor 48 is moved upwardly until a proper amount of tension is in the drive belt 78. Then, the mounting screws 56 are tightened to clamp the motor 48 to the frame 20.

Frame 20 may be provided with a plurality of laterally spaced apart openings 80 in its upper end portion (34), to form a simple but effective handle. The openings 80 receive fingers of a person's hand. The fingers are inserted into and through the openings 80 and a portion of the frame 20 above the openings 80 is grasped. As shown by FIGS. 6–8, the brace leg 82 projects rearwardly from the cross member 64, substantially perpendicular to the frame 20. Leg (or brace) 82 may be a bolt that is threaded into the threaded opening and cross member 64, making it adjustable. Rotation of the bolt 82 in the clockwise direction will move its head closer to the frame 20 and thus shorten the length of the brace leg. Rotation in the opposite direction will move the head of the bolt 82 away from the frame 20, thus increasing the length of the brace leg 82.

Referring to FIG. 8, the forward end of the driven shaft 58 projects forwardly through and from bearing 60. Referring to FIG. 8, end portion 84 is shown to be threaded. A cup shape housing 86 is positioned forwardly of the bearing 60. Housing 86 includes a hub 88, a bottom wall 90 and a sidewall 92. End portion 84 of driven shaft 58 projects forwardly through an opening in the hub 88. The nut 94 is installed on threaded portion 84 and is used to secure the housing 86 to the driven shaft 58. As shown by FIG. 8, the interior of sidewall 92 includes a plurality of axially extending ribs 96. These ribs 96 extend radially from the sidewall 92 a small distance into the interior of the housing 86.

Referring to FIG. 6, gold pan 18 includes a rearwardly projecting housing 98 that is preferably cylindrical in form. It is connected to the gold pan bottom 100 and projects rearwardly from it. Preferably, it includes a wall 102 that is spaced rearwardly from but is parallel to the gold pan bottom 100. As shown by FIG. 6, the rearwardly projecting housing 98 plugs into the forwardly opening housing 86. The outside diameter of housing 98 is slightly smaller than the inside diameter of housing 86. However, the ribs 96 present rib surfaces that lie on a circle that has a diameter smaller than the diameter of housing 98. As a result, there is an interference fit between the rib 96 and the outside surface of the housing 98. This fit, provided by the ribs 96, holds the gold pan 18 secured to the housing 86.

Figure 4:
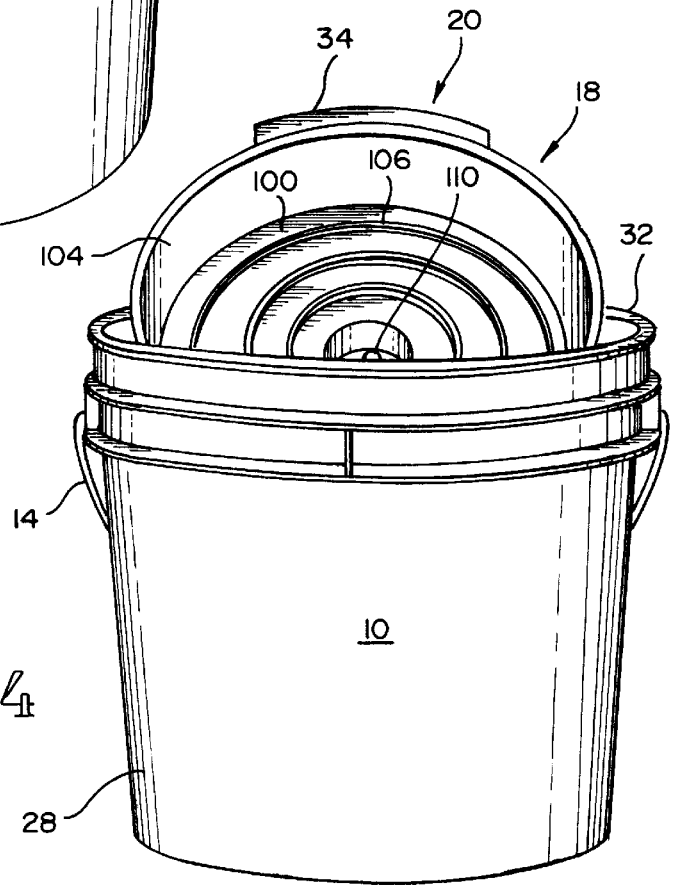
FIG. 4 is a pictorial view taken from above and looking towards the top and front of the gold pan assembly shown by FIG. 3.

Referring to FIGS. 2–4, in addition to a bottom 100, the gold pan 18 includes a sidewall that extends forwardly from the periphery of the bottom 10. A spiral rib 106 is formed on the front side of the bottom wall 100. Rib 106 spirals inwardly from the sidewall 104 to a gold particle collecting upper region 108. My aforementioned U.S. Pat. Nos. 5,273,165; 5,275,294 and 5,788,293 describe in detail the operation of the gold pan 18 and the function of the spiral rib 106. In addition, Pat. No. 5,788,293 discloses a removable hub cup that the gold collecting hub region of the gold pan. Preferably, such a hub cup 110 is a part of the gold pan 18. The hub cup and its handle are described in Pat. No. 5,788,293. This description is hereby incorporated herein by this specific reference.

Once the drive motor 48 and the other drive components 52, 74, 78, 86, etc. are connected to the frame 20, they are left connected to the frame 20. When it is desired to use the gold pan assembly, the gold pan 18 is connected to the drive housing 86. That is, housing 98 at the rear of gold pan 18 is plugged into drive housing 86. Next, the lower end portion of the frame 20 and a lower portion of the gold pan 18 are placed into the interior 30 of the bucket 10 and are moved downwardly, with brace 82 adjacent the bucket sidewall 28, until the mounting hooks 42 have engaged the upper edge 32 of the bucket 10, as shown by FIG. 6. Once the hooks 42 have engaged the edge 32 of the bucket 10, the gold pan 18 and the rest of the assembly are mounted onto the bucket in a rearwardly leaning aptitude. If the lean angle needs to be adjusted, this can easily be done by rotating the brace leg 82 in the direction required to provide the desired lean angle.

The electric motor 48 may be powered by a portable storage battery 22 and the motor 48 may be connected to the battery by a battery cable 24. Preferably, the assembly includes an off/on switch 112 having an "on" position and an "off" position. In place of a separate battery 22, a different type of battery might be directly or indirectly secured to the frame 20. For example, an electric motor may be used that is like the electric motors used in cordless power tools. Such motor has a plug in/pull out rechargeable battery.

When the gold pan assembly is properly adjusted in position on the bucket 10, the assembly is ready for use. The power to the motor 48 is turned on, by use of switch 112, to start rotation of the gold pan 18. As described in my U.S. Pat. No. 5,275,294, for example, the spiral rib 106 and the bottom wall 100 together define a spiral groove between them that captures small gold particles. Material to be separated, i.e. gold ore, is introduced into the pan 18 in the lower portion of the pan 18 where its sidewall 102 meets its bottom 100. Large materials and most low specific gravity materials row or tumble down the pan and over the sidewall 104 and out of the pan 18 as the pan rotates. The largest specific gravity materials (e.g. gold, platinum, etc.) sink to the lowest region where the rib or riffle 106 starts its move away from the sidewall 104. These large specific gravity materials are held in the groove that is formed by and between the spiral rib 106 and the bottom 10. Rotation of the pan 18 causes this material to move upwardly in the groove towards the hub region of the pan 18. Eventually, the load or other high specific gravity material is collected in the hub cup 110. Either after a substantial amount of the particles have been collected, or at the end of operation, the motor 48 is turned off and the hub cup 110 is removed from the pan 18. The collected gold particles or other substance is removed from the hub cup 110 and the hub cup 110 is placed back into the hub region of the pan 18.

Figure 9:
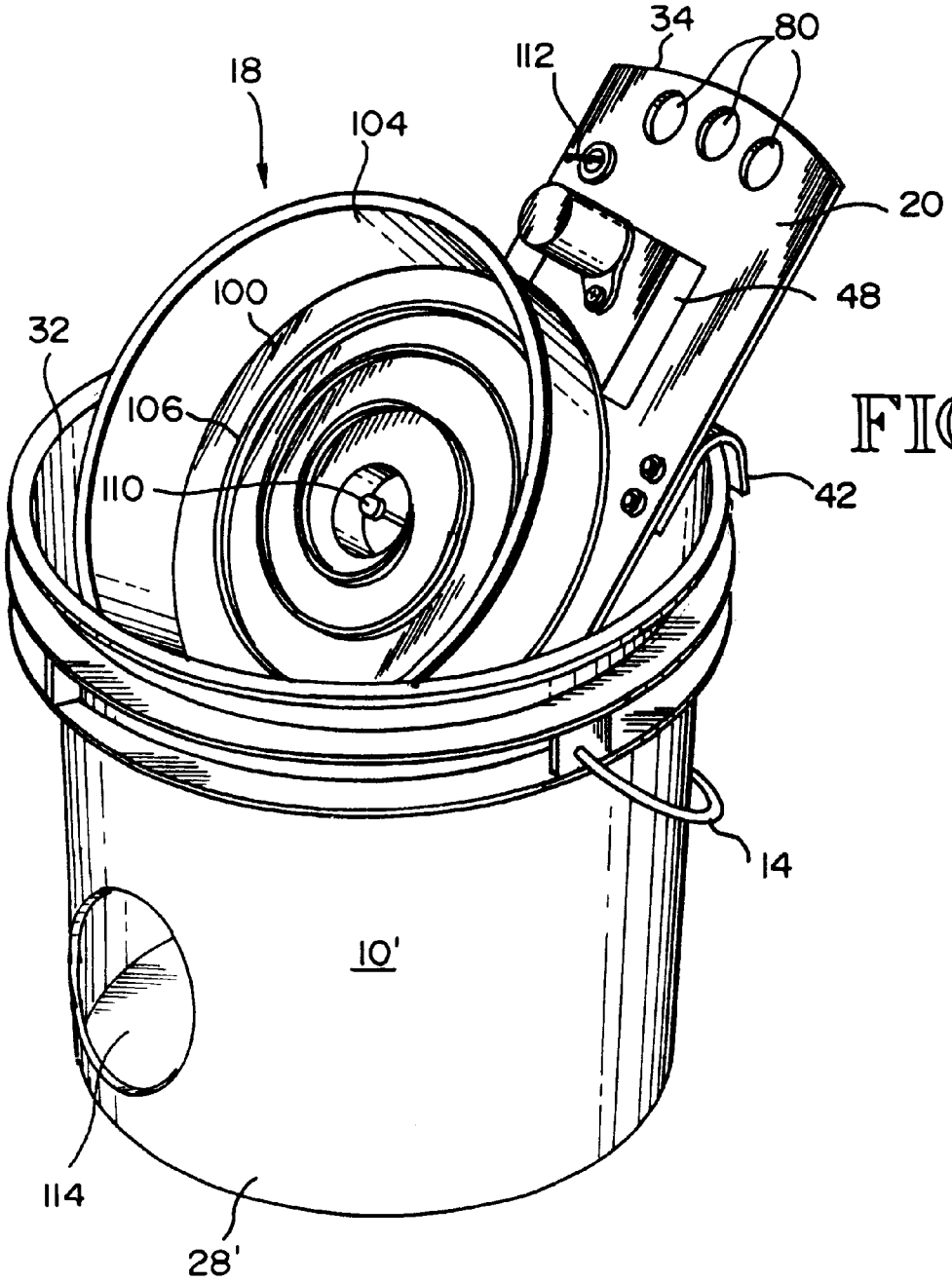
FIG. 9 is a view like FIG. 3, but showing a modified bucket that includes a side opening providing an outlet from the bucket for the ore that spills out of the gold pan into the bucket.

Eventually, the material that has gravitated out of the pan 18 into the bucket 10 will fill the bucket 10. When this happens, one person may pick up the frame and gold pan assembly and move it away from the bucket 10, taking care to not substantially change the lean angle of the pan 18, and a second person can pick up the bucket and empty the collected material from it. Then, the bucket can be placed back on the ground or in the stream bed, etc, the pan and frame assembly can be remounted onto the bucket, and use can be resumed. Alternatively, a bucket 10' can be used that has a sidewall opening 114 in the sidewall 28'. Then, when the frame and pan 20, 18 are assembly on the bucket 10', the lower portion of the pan 118 is positioned as shown in FIG. 9, so as to discharge the material towards the opening 114. In use of this assembly, the material to be separated is introduced into the pan 18 as before, while the pan 18 is being rotated. As before, the large materials and most low specific gravity materials will roll or tumble downwardly and over the sidewall 104 and out of the pan 118, into the bucket 10. As this material accumulates in the bucket, it will eventually flow out of the bucket 10' through opening 114. Presence of the opening 114 will allow continuous use of the gold pan until the user desires to stop. It will not be necessary for the user to stop for the purpose of emptying accumulated material from the bucket.

The example embodiments that are illustrated and have been described with reference to the illustrations are not to be used to limit the scope of protection. Rather, the scope of protection is to be determined by the claims which follow, interpreted in accordance with the established rules of patent claim interpretation, including use of the doctrine of equivalents. Also, it is intended that the specific structures that are illustrated and described constitute a disclosure of the broader principles that they exemplify and embody. For example, a specific frame has been illustrated and described but this specific disclosure also broadly describes the use of a frame that is suitable for supporting drive equipment and being mounted on a side portion of a bucket.

What is claimed is:

1. A separator for separating gold particles from gold ore, comprising:

a bucket having a bottom and a sidewall extending upwardly from the bottom to form a bucket interior, said sidewall having an upper edge;

a frame having an upper end, a lower end, a front side and a rear side;

at least one hook on the rear side of the frame adapted to hook onto the upper edge of the bucket while the lower end of the frame is in the bucket interior;

a rotatable separator pan mounted on the front side of the frame, said pan including a bottom wall with front and rear sides and a perimeter, a gold particle collecting hub region, a sidewall projecting forwardly from the perimeter of the bottom wall, and a spiral rib on the front side of the bottom wall, spiraling inwardly from the sidewall to the gold particle collecting hub region;

a motor on the frame connected to the pan for rotating the pan relative to the frame and bucket; and a brace on the frame below the hook, extending rearwardly from said frame into contact with the sidewall of the bucket, said brace holding the frame and the pan in rearwardly leaning positions, wherein in preparation for use, lower portions of the frame and the pan are placed in the bucket interior, the hook is hooked onto the upper edge of the sidewall of the bucket, and the brace is positioned against the sidewall, to hold the frame and the pan in rearwardly leaning positions on said bucket, and wherein in use gold ore is introduced into the pan while the pan is rotating, and relatively large particles of the ore gravitate radially across the pan and rib and over the sidewall, and out of the pan, into the bucket, and small gold particles will be held by the rib and be moved by the rib upwardly along the spiral path of the rib into the gold particle collecting hub region of the pan.

2. The separator of claim 1, wherein the gold particle collecting hub region of the separator pan includes a hub housing projecting rearwardly from the bottom of the pan, and a removable gold particle collecting cup that is fittable into the housing from the front side of the pan.

3. The separator of claim 2, wherein a second, forwardly directed housing is mounted for rotation on the frame and is connected to the motor to be rotated by the motor, and the rearwardly projecting housing on the pan is plugable into the forwardly opening second housing on the frame, to provide a drive connection between the pan and the second housing and the motor.

4. The separator of claim 3, wherein the brace is adjustable in length, for adjusting the lean angle of the frame and pan.

5. The separator of claim 4, comprising a handle at the upper end of the frame.

6. The separator of claim 1, wherein the brace is adjustable in length, for adjusting the lean angle of the frame and pan.

7. The separator of claim 6, comprising a handle at the upper end of the frame.

8. The separator of claim 1, comprising a handle at the upper end of the frame.

9. The separator of claim 1, wherein the motor is on an upper part of the frame and includes the drive shaft that projects rearwardly from the frame, and a driven shaft is mounted on a lower portion of the frame, said driven shaft having a front portion that extends forwardly from the frame and is connected to the rotatable separator pan, and a rear portion that projects rearwardly from the frame, a drive pulley on the drive shaft rearwardly of the frame, a driven pulley on the driven shaft, rearwardly of the frame, and a drive belt interconnecting the drive pulley and the driven pulley.

10. The separator of claim 9, wherein the gold particle collecting hub region of the separator pan includes a hub housing projecting rearwardly from the bottom of the pan, and wherein a forwardly directed housing is connected to the forward portion of the driven shaft, and the rearwardly projecting housing on the pan is plugable into the forwardly opening housing on the driven shaft, to provide a drive connection between the pan and the driven shaft.

11. The separator of claim 10, wherein the brace is adjustable in length, for adjusting the lean angle of the frame and pan.

12. The separator of claim 11, comprising a handle at the upper end of the frame.

13. The separator of claim 11, comprising a handle at the upper end of the frame.

14. The separator of claim 9, comprising a handle at the upper end of the frame.

15. The separator of claim 1, wherein the pan is detachable from the frame and the pan and frame are sized to when detached be fittable into the bucket interior.

16. The separator of claim 1, wherein the bucket includes an opening in its sidewall, and wherein the frame is hooked onto the bucket at a location that is substantially diametrically opposite the opening, so that gold ore falling into the bucket can flow out from the bucket through the opening in the sidewall of the bucket.

* * * * *